United States Patent [19]

Rohde et al.

[11] 4,390,138

[45] Jun. 28, 1983

[54] REELING APPARATUS FOR A WEB

[75] Inventors: Günter Rohde, Zang; Friedrich Kuhn, Heidenheim, both of Fed. Rep. of Germany

[73] Assignee: J. M. Voith GmbH, Fed. Rep. of Germany

[21] Appl. No.: 252,879

[22] Filed: Apr. 10, 1981

[30] Foreign Application Priority Data

Apr. 23, 1980 [DE] Fed. Rep. of Germany ..... 3015547

[51] Int. Cl.[3] ..... B65H 75/02; B65H 17/08

[52] U.S. Cl. ..... 242/55; 242/65; 242/81

[58] Field of Search ..... 242/55, 65, 58.6, 67.1 R, 242/68.7, 55.1, 81, 84

[56] References Cited

U.S. PATENT DOCUMENTS

| | | | |
|---|---|---|---|
| 1,949,997 | 3/1934 | Fourness | 242/65 |
| 2,703,683 | 3/1955 | Evans | 242/65 |
| 3,103,321 | 9/1963 | Jilek | 242/65 |
| 3,116,031 | 12/1963 | Moore | 242/65 |
| 3,131,880 | 5/1964 | Miller et al. | 242/55 |
| 3,202,374 | 8/1965 | Phelps | 242/65 |
| 3,258,217 | 6/1966 | MacArthur | 242/65 |
| 3,586,253 | 6/1971 | Gilbank | 242/65 |
| 4,208,019 | 6/1980 | Dusenbery | 242/81 |

*Primary Examiner*—Edward J. McCarthy

*Attorney, Agent, or Firm*—Ostrolenk, Faber, Gerb & Soffen

[57] ABSTRACT

An apparatus and method are disclosed for reeling a web, for instance a web of paper, on a winding shaft over which core tubes are fitted. A lifting device engages the completed roll only at the periphery thereof and lifts it to an extraction position, where an extraction device extracts the winding shaft. The same lifting device moves a new core tube to the extraction station, where the winding shaft is inserted in the core tube. The combination of winding shaft and the new core tube is then lifted, either by the same lifting device or by a separate lifting mechanism, to a return roller path along which the shaft rolls, and at the end of which the shaft is received by an additional lifting device. The additional lifting device lowers the shaft, delivering it to the jaws of a pivotable reel swing member, which pivots to bring the winding shaft with the new core tube into the position at the application station for winding a new roll therein. The entire cycle can thus be performed quickly with a simple machine, without the use of external hoists, etc.

22 Claims, 2 Drawing Figures

REELING APPARATUS FOR A WEB

BACKGROUND OF THE INVENTION

The present invention relates to a reeling apparatus for reeling a web of material, for instance a web of paper, on a winding shaft over which core tubes are fitted, and, more particularly, pertains to a reeling apparatus having a carrier drum against the surface of which the winding shaft, which is then bearing core tubes, can be placed paraxially in an application station, and having a swing device for swinging the winding shaft toward the side of the carrier drum which faces away from the on-coming web (i.e., toward the discharge side), and having a device for holding and guiding the winding shaft during the winding process and for rolling the finished roll out of the winding position.

Reeling devices of this type are provided at places where webs are to be wound up, for instance at the end of a paper machine, or following a roll slitting machine, or the like. A winding shaft, having been newly placed on the supporting and guiding device, is conventionally pressed by hydraulically actuatable swing levers against the carrier drum or possibly against two carrier drums. In the known reeling apparatus of this type, the finished roll is decelerated at the end of the supporting and guiding device and then gripped on the winding shaft by a crane, transported to another place and deposited there, for instance in a prism, after which the winding shaft is removed from the finished roll. For this purpose, an extraction device is brought to the side of the roll and is aligned so that it can engage the winding shaft. After the winding shaft has been extracted, the core tubes remain in the roll. The roll is then rolled away, for instance by swinging the supporting prism. The winding shaft is provided with new core tubes and is conveyed back to the reeling apparatus by means of the crane. This method is cumbersome and time consuming.

SUMMARY OF THE INVENTION

The object of the present invention is to create a reeling apparatus by means of which the entire process of winding, extracting the winding shaft and refitting it with core tubes, and returning the fitted winding shaft to the application station, can be carried out in a more rational fashion which would permit the entire process to be performed automatically.

The present invention provides a reeling apparatus which, in its preferred embodiment, combines the following features:

(a) means for supporting the finished roll, which has been removed from the winding position, on its circumference in order to free the winding shaft to be extracted;

(b) an extraction device for pulling the winding shaft out of the roll while the latter is so supported;

(c) a fitting station for fitting fresh core tubes onto the exposed winding shaft; and (d) a conveyor device for transporting the freshly fitted winding shaft from the fitting station to the application station.

With a reeling apparatus which has these features, long transportation paths with a crane are avoided and only a single operator is required. The entire course of the operation—starting from the application of the winding shaft and proceeding through the winding, the extraction of the winding shaft from the finished roll, the refitting of the winding shaft with new tube cores and the return of the fitted winding shaft to the application station—is effected in a single machine with the gentlest possible treatment of the winding shaft, and can be practically completely automated. External hoisting devices are not required. A lift device that acts on the bottom of the roll and has a supporting trough which can be tilted around an axis that is parallel to the winding shaft is preferably used for supporting the finished roll for the purpose of the release of the winding shaft.

As one feature of the invention, the same lift device serves as supporting means for the finished roll and as a holding device for the newly inserted core tubes. This lifting device first raises the finished roll to an elevated position where the winding shaft is freed and pulled out of the roll. The roll is then lowered by the lifting device, and the tiltable supporting trough is tilted to allow the roll to roll off. Fresh core tubes for fitting on the extracted winding shaft are then placed on the lowered lifting device and are raised until they are concentric with the extracted winding shaft, which is introduced into the empty core tubes. The extraction device is then disconnected from the winding shaft, and the newly fitted winding shaft is conveyed by a conveyor device back to the application station.

As a further feature of the preferred embodiment of the invention, the conveyor device comprises a lift device and a return rolling path which extends from a raised position of the lifting device to the application station, toward which the rolling path is slightly inclined downward. The rolling path preferably comprises two rolling rails spaced laterally from each other. The winding shaft is conveyed by this lift device onto the return rolling path and rolls thereon under the influence of gravity back to the application station. In order to avoid too great acceleration of the winding shafts while they move back over the inclined rolling path, and thus too hard impact at the end of the rolling path, the return rolling path is preferably provided with at least one brake device. The brake device preferably comprises a flap on each rolling wall, extending into the rolling path and capable of being actuated hydraulically. These flaps also realign the roll shaft if it has moved faster on one rail than on the other and thus twisted itself obliquely to its roll path.

The support device for the finished roll comprises a lift device for lifting the newly fitted roll shaft up to the return rolling path. Therefore, the same lift device is used:

(a) to lift the full roll into the shaft extraction position and then lower it after extraction of the winding shaft;

(b) to lift the new core tubes into the fitting position (which in the preferred embodiment is the same as the extraction position); and (c) to lift the fitted roll shaft from the fitting position to the return rolling path.

Other objects and features of the invention will be apparent from the following description and the accompanying drawings.

DESCRIPTION OF THE PREFERRED EMBODIMENT

Figure 1:
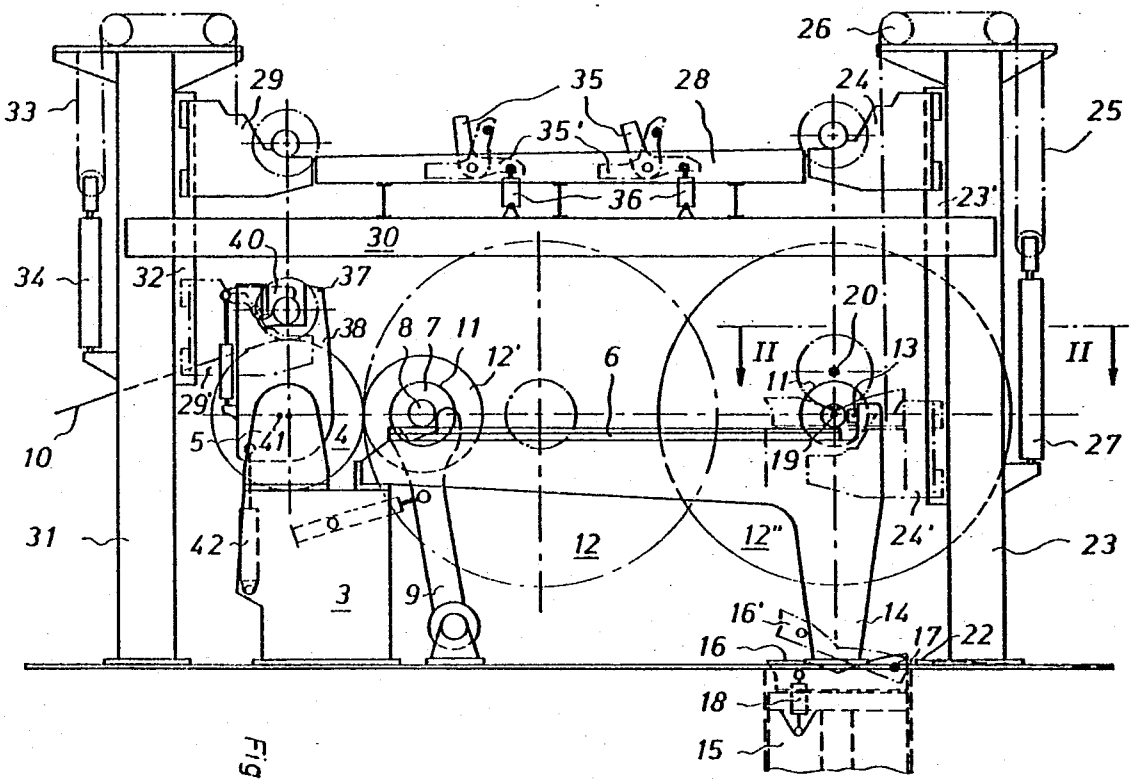
FIG. 1 shows a diagrammatic side view of the reeling apparatus of the invention.

A carrier drum 4 is mounted laterally in bearing brackets 5 on the machine frame 3. It is driven in known manner by a motor, not shown in the drawing. A winding shaft 7 is supported on two spaced apart, parallel rolling paths 6, e.g. rails, only one of which is shown in FIG. 1, by means of anti-friction bearing housings 8. Hydraulically actuated engagement levers 9 urge the winding shaft 7 to the left in FIG. 1, against the supporting drum 4. A web of paper 10, which is moved over the carrier drum 4, is wound onto core tubes 11 fitted over the winding shaft 7, to form a roll 12', which as shown in FIG. 1 is not yet complete. When the roll has been completed, as shown in phantom and indicated by the reference number 12, the winding shaft 7 is moved by means of the engagement lever 9 to the right in FIG. 1 along the rolling paths 6 against bumpers 13, moving the roll 12 into the phantom position indicated by reference numeral 12''. The shaft 7 rolls free of the levers 9 before the roll reaches the position 12''. The rotational movement of the roll is braked in position 12'' by means of a conventional brake (not shown).

Figure 2:
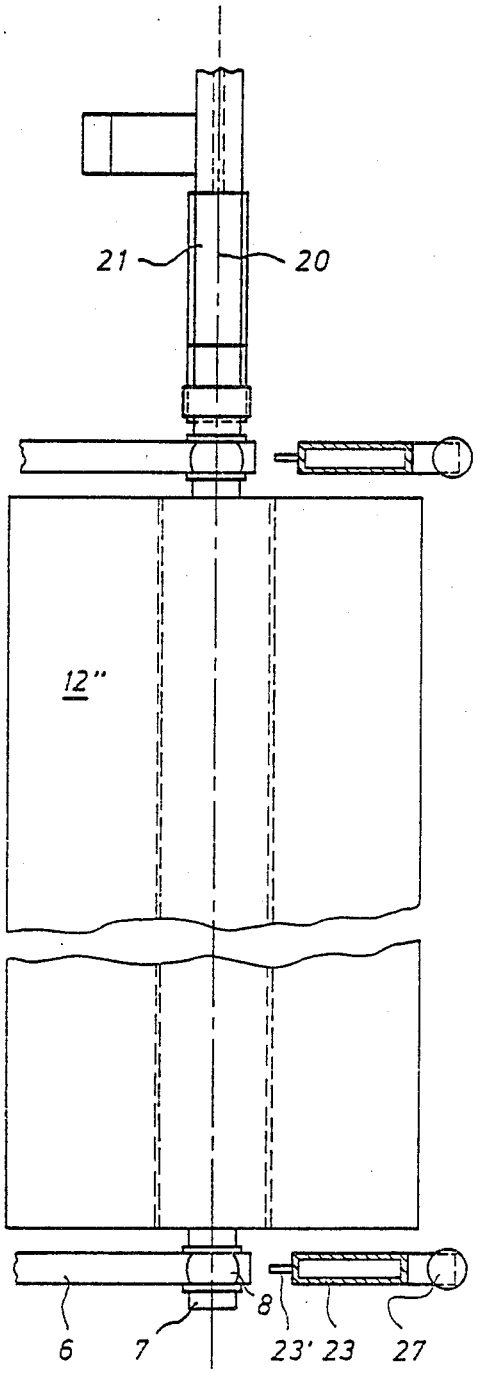
FIG. 2 is a cross section taken along the line II—II of FIG. 1.

The rolling paths 6 are supported at their righthand ends as seen in FIG. 1 by a support 14. A hydraulically raisable and lowerable lift table 15 is located between rolling paths 6. The upper part of the lift table 15 is developed as a supporting trough 16 and is swingable about horizontal axis 17 by means of a hydraulic servomotor 18. By means of lift table 15, the finished roll is raised from position 12'' until the axis 19 of the finished roll coincides with the axis 20 of a roll shaft extraction device 21 (shown in FIG. 2). During the lifting of the roll, the supporting trough 16 engages the outer periphery of the roll. With the roll in this elevated position, the winding shaft 7 is extracted laterally, while the core tubes 11 remain within the roll. The lift table 15 is then lowered and the supporting trough 16 is swung into the position 16' shown in phantom. As a result, the roll 12'' rolls down over the rolling surface 22. New core tubes 11 are placed on the supporting trough 16 and the lift table 15 is raised again until the central axis of the core tubes 11 is aligned with the axis of the extraction device 21. The winding shaft 7 is introduced by the extraction device 21 into the newly inserted core tubes 11 and clamped to the latter.

To the right (downstream) of the rolling paths 6, as seen in FIG. 1, are provided vertical stands 23. Pulleys 26, carrying roller chains 25, are mounted on the stands 23. Lift devices 24 are suspended from roller chains 25 and are guided for vertical movement by guideways 23' provided on stands 23. By means of adjustment cylinders 27 mounted on the stands 23, the lift devices 24 can be moved between a lower position 24' (shown in broken line), below the level of rolling paths 6, and an upper position 24. Stands 31 are provided at the left-hand end of the reeling apparatus, as shown in FIG. 1. Stands 31 carry guideways 32 which guide additional lift devices 29 for vertical movement between an upper position (shown in FIG. 1) and a lower position shown in phantom at 29', which movement is provided by means of pulley chains 33 and hydraulic servomotor 34. A pair of beams 30 extend between stands 23 and stands 31 and support a second pair of rolling paths 28, i.e. rails, which extend between the upper positions of lift devices 24 and 28, inclining slightly downward and toward the latter. Bell crank levers 35, which can be swung by servomotors 36 into the positions shown in phantom at 35', are disposed pivotally on rolling paths 28.

The newly fitted winding shaft 7 is lifted by lift devices 24 up to the level of rolling paths 28, down which it rolls to lift devices 29. The bell crank levers 35 brake the winding shaft 7 traveling down the second, or return, rolling paths 28 and maintain it perpendicular to rolling paths 28 if it should become misaligned relative to them. Reel swing levers 3, having receiving jaws 37 and actuatable holding levers 40, are mounted on brackets 5. The winding shaft 7 is brought by the lift devices 29 to the receiving jaws 37 of reel swing levers 38, in which they are held by the holding levers 40. The swing levers 38 are swingable by means of servomotors 42 around an axis 41 which is slightly eccentric to the axis of rotation of the carrier drum 4, so that the winding shaft 7 can be brought onto the rolling path 6, where it is grasped by the pressing levers 9 and pressed against the carrier drum 4. This completes one cycle of operation of the reeling apparatus, and a new winding process can now commence.

The present invention may be embodied in other specific forms without departing from the spirit or essential attributes thereof, and, accordingly, reference should be made to the appended claims, rather than to the foregoing specification, as indicating the scope of the invention.

What is claimed is:

1. A reeling apparatus for reeling a web on a winding shaft having a core tube fitted over it, said reeling apparatus comprising:

an application station for winding a web onto a core tube fitted over a winding shaft to form a roll around the core tube;

first moving means for moving the roll from said application station to an extraction position for enabling extraction of the winding shaft from the core tube when the roll is at said extraction position, said first moving means comprising second moving means for raising the roll into said extraction position to enable extraction of the winding shaft, and for then moving the roll away from said extraction position; said second moving means being adapted and positioned to engage the periphery of the roll and to not engage the winding shaft and the core tube;

extraction means for extracting the winding shaft from the core tube while the roll is in said extraction position, said second moving means being adapted to maintain the roll in said extraction position while engaging the periphery of the roll, while said extraction means extracts the winding shaft from the core tube;

refitting means for fitting a new core tube on the winding shaft after the winding shaft has been extracted from the roll; and conveyor means for returning the winding shaft to said application station.

2. The apparatus of claim 1, wherein said first moving means further comprises third moving means for moving the roll from said application station to a second position, and said second moving means being for raising the roll from said second position to said extraction position.

3. The apparatus of claim 2, wherein said third moving means comprises a swing device having a respective pivot about which said device is swingable for moving the roll to said second position from said application station.

4. The apparatus of claim 3, wherein said third moving means further comprises rolling path means, said swing device being shaped and positioned for causing the roll to roll along said rolling path means to said second position.

5. The apparatus of claim 3, wherein said application station further comprises a carrier drum located to be in contact with the core tube on the winding shaft and with the periphery of the roll being wound on the core tube and said carrier drum being adapted to have a web fed over it for winding the web on the core tube on the winding shaft that is located at said application station, and while at said application station, said swing device urging the winding shaft to move the core tube against said carrier drum for winding a roll thereon.

6. The apparatus of claim 1, wherein said second moving means is positioned for engaging the bottom peripheral portion of the roll and for raising the roll to said extraction position and for then lowering the roll away from said extraction position.

7. The apparatus of claim 6, wherein said second moving means further comprises a supporting trough adapted to engage the bottom peripheral portion of the roll, said trough being supported for rotation about an axis parallel to the axis of a roll engaged by said trough, for causing the roll to roll off said trough when said first moving means has lowered the roll from said extraction position.

8. The apparatus of either of claims 1 or 6, wherein said second moving means and said extraction means cooperate to serve as said refitting means, said second moving means further being for moving a new core tube to said extraction position, and said extraction means further being for inserting the winding shaft into the new core tube while the new core tube is at said extraction position.

9. The apparatus of claim 1, wherein said conveyor means further comprises return rolling path means adapted to have the winding shaft roll therealong, and first lift means for moving the winding shaft from said extraction position to said return rolling path means and depositing it thereon to roll therealong to said application station.

10. The apparatus of claim 9, wherein said return rolling path means is inclined downward away from a location at which said first lift means is adapted to deposit a roll thereon, thereby to cause the winding shaft to roll to said application station.

11. The apparatus of claim 10, wherein said conveyor means further comprises brake means cooperating with said return rolling path means for decelerating a roll which is rolling along said return rolling path means.

12. The apparatus of claim 11, wherein said brake means comprises bell crank lever means pivotally secured to said return rolling path means and extending into the path of a roll which is rolling along said return rolling path means, said bell crank lever means being adapted to resist the movement of a roll along said return rolling path means and then to move out of said path.

13. The apparatus of claim 9, wherein said conveyor means further comprises second lift means for lowering the winding shaft from said return rolling path means to said application station.

14. The apparatus of claim 13, wherein said conveyor means further comprises a reel swing member having jaws for receiving the winding shaft from said second lift means, said jaws being disposed to be pivotable as a unit about a predetermined axis for bringing the winding shaft into position at said application station for having a new roll wound on the winding shaft.

15. A method for reeling a web on a winding shaft having a core tube fitted thereover and then reusing the winding shaft to wind a second roll, said method comprising the steps of:

winding a web onto a winding shaft having a core tube fitted thereover, to form a roll; said winding step being performed at an application station;

after the roll has been wound, moving it to an extraction position, said moving step including raising the roll to the extraction position and maintaining it there by engaging the peripheral portion of the roll and by not engaging the winding shaft;

extracting the winding shaft from the roll while the roll is at the extraction position;

lowering the roll from the extraction position; and conveying the winding shaft from the extraction position back to the application station.

16. The method of claim 15, wherein said moving step further comprises rolling the roll from the application station to a second position before performing said raising step.

17. The method of claim 16, further comprising the step of tilting the roll to cause it to roll away, after it has been lowered from the extraction position.

18. The method of claim 16, wherein said step of conveying the winding shaft to the application station comprises lifting it from the extraction position and rolling it along a return rolling path.

19. The method of claim 18, wherein said conveying step further comprises braking the roll as it rolls along the return rolling path.

20. The method of claim 18, wherein said conveying step further comprises lowering the winding shaft from the return rolling path to the application station.

21. The method of claim 20, wherein said lowering step further comprises the step of pivoting the winding shaft into position at the application station for winding a new roll thereon.

22. A reeling apparatus for reeling a web on a winding shaft having a core tube fitted over it, said reeling apparatus comprising:

an application station for winding a web onto a core tube fitted over a winding shaft to form a roll around the core tube;

a swing device having a respective pivot about which the swing device is swingable, for moving the roll from said application station to a second position; second means for engaging the periphery of the roll while not engaging the winding shaft and the core tube, for holding the finished roll in a position permitting extraction of the winding shaft from the core tube;

extraction means for extracting the winding shaft from the core tube while the roll is being held by the second means at the extraction position; said second means being adapted to maintain the roll in the said extraction position while engaging the periphery of the roll, and while the extraction means extracts the winding shaft from the core tube;

refitting means for fitting a new core tube on the winding shaft after the winding shaft has been extracted from the roll; and conveyor means for returning the winding shaft to said application station.

* * * * *